US010219676B2

(12) United States Patent
Woolman et al.

(10) Patent No.: US 10,219,676 B2
(45) Date of Patent: Mar. 5, 2019

(54) LINT REMOVING DEVICE

(71) Applicants: Daniel Woolman, London (GB); Stuart Woolman, Charlotte, NC (US)

(72) Inventors: Daniel Woolman, London (GB); Stuart Woolman, Charlotte, NC (US)

(73) Assignee: TPL IP HOLDINGS LIMITED (GB)

( * ) Notice: Subject to any disclaimer, the term of this patent is extended or adjusted under 35 U.S.C. 154(b) by 674 days.

(21) Appl. No.: 14/782,684

(22) PCT Filed: Apr. 11, 2014

(86) PCT No.: PCT/EP2014/057366

§ 371 (c)(1),
(2) Date: Oct. 6, 2015

(87) PCT Pub. No.: WO2014/167093

PCT Pub. Date: Oct. 16, 2014

(65) Prior Publication Data

US 2016/0256034 A1 Sep. 8, 2016

(30) Foreign Application Priority Data

Apr. 11, 2013 (GB) ..... 1306560.2

(51) Int. Cl.
*A47L 25/00* (2006.01)

(52) U.S. Cl.
CPC ..... *A47L 25/005* (2013.01)

(58) Field of Classification Search
CPC ..... A47L 25/005; A46B 7/026; A46B 2200/3073
See application file for complete search history.

(56) References Cited

U.S. PATENT DOCUMENTS

| | | | | |
|---|---|---|---|---|
| 1,588,633 | A * | 6/1926 | Taylor | A45D 27/04 132/290 |
| 2,542,774 | A | 2/1951 | Hutchinson | |
| 4,180,163 | A * | 12/1979 | Grioni | A45D 40/06 206/385 |
| 2005/0183223 | A1 | 8/2005 | Cheng | |
| 2011/0078866 | A1 * | 4/2011 | Panthofer | A47L 25/005 15/104.002 |
| 2012/0284939 | A1 | 11/2012 | Anderson | |

FOREIGN PATENT DOCUMENTS

| | | |
|---|---|---|
| DE | 1628830 | 9/1967 |
| EP | 0966915 | 12/1999 |

(Continued)

OTHER PUBLICATIONS

International Search Report to corresponding Int'l Pat. Appl. No. PCT/EP2014/057366, dated Jul. 17, 2014, 2 pages.

*Primary Examiner* — Shay Karls
(74) *Attorney, Agent, or Firm* — Tarolli, Sundheim, Covell & Tummino LLP

(57) ABSTRACT

A lint removing device (10), the device (10) comprising: a housing (12), a roller (14) for holding a lint-removing material (141), wherein the roller (14) and lint-removing material (141) are dimensioned and configured to be housed by the housing (12), wherein the roller (14) and housing (12) are arranged such that the roller (14) is deployable from the housing (12); and an actuator (16) coupled with or formed by either the roller (14) or the housing (12), the actuator (16) being manipulable by a user to deploy the roller (14).

28 Claims, 8 Drawing Sheets

(56) References Cited

FOREIGN PATENT DOCUMENTS

| | | |
|---|---|---|
| FR | 2061340 | 9/1970 |
| GB | 2257618 | 1/1993 |
| JP | 2007319462 | 12/2007 |
| WO | 8301734 | 5/1983 |

* cited by examiner 10
14
144
22
161

10
20
18
22
188
161
201

181
18

14
20
18
22
161
144
10

10
14
20
18
22
161
144

LINT REMOVING DEVICE

The present invention relates to a device for lint removal.

Commonly, lint is known as meaning short fine fibres, which separate from cloth and other materials and which can lie on the surface of clothing and other surfaces. A variety of methods for lint removal are known in the art. A commonly used known lint remover consists of a roll of a lint-removing adhesive-bearing material rotatably mounted on a spindle, attached to a handle. In use, the user rolls the lint remover around the spindle over or along the surface of an object and any lint on the surface adheres to the lint-removing adhesive material. Lint rollers may also pick up and remove other materials such as hairs including pet fur, dust and other particles. In this specification, the word "lint" is intended to encompass all of these materials.

The lint-removing material is provided in a roll, so that, once an area of the material has been used up, and is no longer sticky because it is covered with lint, the used-up area can be torn off to reveal a new unused area below. The roll can be perforated into discrete sheets that can be torn off. Alternatively, the discrete sheets of a roll may not contain perforated parts between them but the roll may comprise discrete sheets simply placed next to one another around the roll. As known in the art, the sheets have a backing and a pressure sensitive adhesive (PSA) used as the sticky material on the sheets can adhere to the backing of the sheets, when rolled, but may be pulled apart by a user. In other words, the sticking force of the PSA on the backing can be overcome by a user removing one sheet from the roll. Preferably, the sheet may be perforated or separated on a bias with respect to the roll, i.e. diagonally.

However, there are several problems with known lint removers. The known arrangements are quite large and not easily portable. As the lint-removing adhesive material is always exposed around the roll, the lint-removing adhesive material can pick up any dirt or unwanted material, particularly when being transported. This renders the adhesive less effective for lint removing and also very unsightly as the adhesive is covered in lint, hair, dirt and debris. Furthermore this means that more sheets of lint-removing sticky materially are used. Additionally, known lint rollers do not provide a good use experience. Some examples of known lint roller assemblies are disclosed in GB2257618 (A) and EP0966915 (A1).

Some efforts have been made to overcome these problems, for example US patent publication 2011/0078866 A1 discloses a transportable lint remover. However this application does not fully address the problems mentioned above as the lint remover is bulky and difficult to operate.

US patent publication 2012/0284939 A1 discloses a further roller assembly which includes a separate case in the manner of a spectacles case and is therefore rather bulky.

Furthermore US patent publication 2005/0183223 A1 discloses a roll of adhesive-coated material within a hinged housing.

A further prior art lint remover is described in international patent publication WO 83/01734. In this arrangement the roll of lint is also included in a split or divided casing.

Further prior art lint removers are disclosed in German publication DE 1993135 U and Japanese patent publication JP 2007319462 A.

The present invention relates to compact and portable device for removing lint that seeks to overcome the above problems. In the invention, the roller holding the lint-removing adhesive material is contained by a housing when not being used, such that when the roller is carried around, for example in a handbag or personal bag or pocket, the roller is protected from dirt and other material that might stick to the adhesive material and otherwise render it ineffective. The roller is also easy for the user to deploy from the housing. As the skilled person will see from the below description, the present invention has clear advantages over the prior art.

According to the present invention, there is provided a lint removing device comprising:

a housing;

a roller for holding a lint-removing material, wherein the roller and lint-removing material are dimensioned and configured to be housed by the housing, wherein the roller and housing are arranged such that the roller is deployable from the housing; and an actuator coupled with or formed by either the roller or the housing, the actuator being manipulable by a user to deploy the roller characterised in that the actuator is arranged to transversely move the roller with respect to the housing.

Advantageously, the roller and the housing are moveable with respect to each other.

Conveniently, the actuator is rotatable with respect to the housing.

Preferably, the roller comprises at least one radially-projecting pin that engages a corresponding portion of the housing.

Advantageously, the housing comprises at least one slot to receive a corresponding pin of the roller.

Preferably, the roller is mounted on the housing by at least one radial roller pin or roller thread on a corresponding screw thread on an internal bore of the housing.

Conveniently, the actuator is coupled to the roller and is slidable along a slot of the housing to deploy the roller.

Advantageously, the roller is resiliently biased and preferably spring biased to a deployed or un-deployed position.

Preferably, the housing slot or housing screw thread is terminated by a catch to limit deployment of the roller.

Conveniently, the device further comprises a notch on or in the housing to limit deployment of the roller.

Advantageously, the proximal end of the roller has at least one flange.

Preferably, the distal end of the housing has at least one circumferential lip.

Conveniently, the actuator is a trigger coupled to the roller.

Advantageously, the actuator is formed by at least a section of the housing and is movable to be at least partially housed by a further portion of the housing.

Preferably, the roller comprises a roll of lint-removing material and a piston.

Conveniently, the roller further comprises a spindle.

Preferably, the lint-removing material comprises a backing material coated with an adhesive.

Conveniently, the roll of lint removing material further comprises a tube around which the lint-removing material is wound.

Preferably, the housing is cylindrical.

Advantageously, the device further comprises a removable cover, and preferably a metal cover.

Conveniently, the cover comprises two parts, one part having a greater length than the other.

Preferably, the distal end of the roller is provided with a cap.

Advantageously, the cap is connectable to the roller in order to retain the roll of lint removing material on the roller.

Advantageously the actuator is connected to or formed with a helix or screw thread that is coaxial with the housing.

Conveniently the coaxial helix or screw thread is engageable with a corresponding screw thread of the roller.

Preferably the roller screw thread is provided on the roller or on a traveller seated on or in the roller.

Advantageously, the roller comprises a lint slider element formed of two separable parts.

Conveniently, the roller further comprises a core having at least one and preferably two diametrically opposed, longitudinal slots.

Preferably the roller screw thread is provided by lugs of the roller, and if the roller comprises the slider element each part or the slider element is provided with a lug, the lugs being dimensioned and configured to travel along the or each longitudinal slot.

Conveniently the roller screw thread is provided by an internal bore of the traveller, the traveller having lugs being dimensioned and configured to travel along the or each longitudinal slot.

Aspects of the invention will now be described with reference to the attached drawings, in which:

FIG. 1 A depicts a cross-sectional view of a device for lint removing and shows a housing, a roller and an actuator. FIG. 1 B depicts a cross-sectional view of the same roller;

Figure 1A:
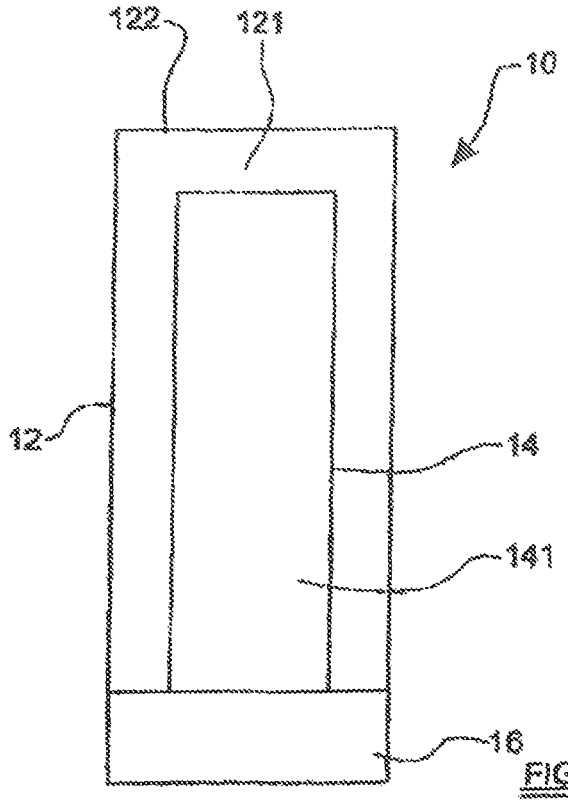
Figure 1B:
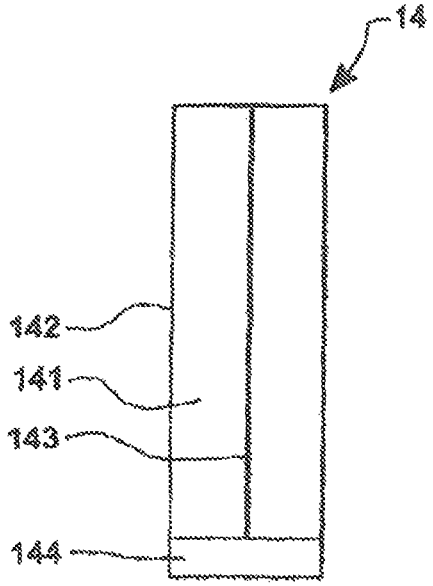

FIGS. 1 through 9 depict several alternative arrangements of the lint remover 10 of the invention and their component parts. FIG. 1A is a generalised view showing various important components of the invention. In FIG. 1A the device 10 is represented as comprising a cylindrical housing 12. The housing comprises an exterior surface and an interior bore that defines an inner chamber 121, with distal opening 122. In this specification and claims "distal" refers to the area through which the roller is deployed and "proximal" refers to the area away from which the roller is deployed, namely the area to be held and/or manipulated by the user. It can be appreciated the external surface of the housing 12 can be contoured for functional or aesthetic purposes, for example for easy gripping by a user. The housing 12 houses a roller 14, as depicted in FIG. 1 B; the roller may comprise a roll 142 of lint removing material or tape 141 and a spindle 143 attached a piston 144. The roller 14 may further comprise a tube, located in the centre of the roll 142. The lint-removing material may be wound about this tube and the tube may be mounted on a spindle. The tube may further be constructed of, for example, plastic or cardboard.

Lint-removing materials are known in the art. Lint-removing materials can be any substance that lint can adhere to, for example an adhesive on one side of a backing material, i.e an adhesive tape using, for example a pressure-sensitive adhesive (PSA).

One arrangement of the present invention includes a roller 14 on which is wound a roll 142 of backing material coated with an adhesive, i.e. tape 141. Moreover, the roll 142 may be perforated to form sheets. Thus, when one sheet of the lint-removing material 141 has been used up (i.e. covered with lint or other material to the extent that it no longer effectively picks up more lint) the sheet may be torn of to reveal another unused sheet below. Each perforated sheet on the backing material is preferably sized to circle the roller 14 once, so that one sheet covers the outer surface of the roller 14. The roll 142 of material 141 may contain between 20 to 50 individual sheets separated by perforations. Preferably there are 40 sheets on the roll 142 of material 141. The roll 142 of lint removing material 141 may be replaceable.

As described above, the individual sheets may not be separated by perforations but may merely be placed in close proximity on a roll. The sheets may be cut in a diagonal manner such that each sheet wraps around the roll 142 on a bias. The front face of the material 141 which is intended to pick up lint is provided with a pressure sensitive adhesive (PSA). When the material 141 is wrapped around the roll 142, the backing of the material 141 adheres to the pressure sensitive adhesive with a force which may easily be overcome by a user peeling the material off the backing.

The roll 142 may be in a fixed arrangement, or the roll 142 may rotate around on a spindle 143. The roller 14 functions as the means by which lint and other material can be removed with the device 10.

There is also provided an actuator 16, which can be coupled to either the housing 12 or the roller 14. The term "actuator" and variations thereof mean an element, device or mechanism, which is operable to deploy the roller 14 from the housing 12. It can be appreciated the actuator 16 can take a variety of a forms, as described below.

Figures 2A, 2B, 2C, 2D, 2E:
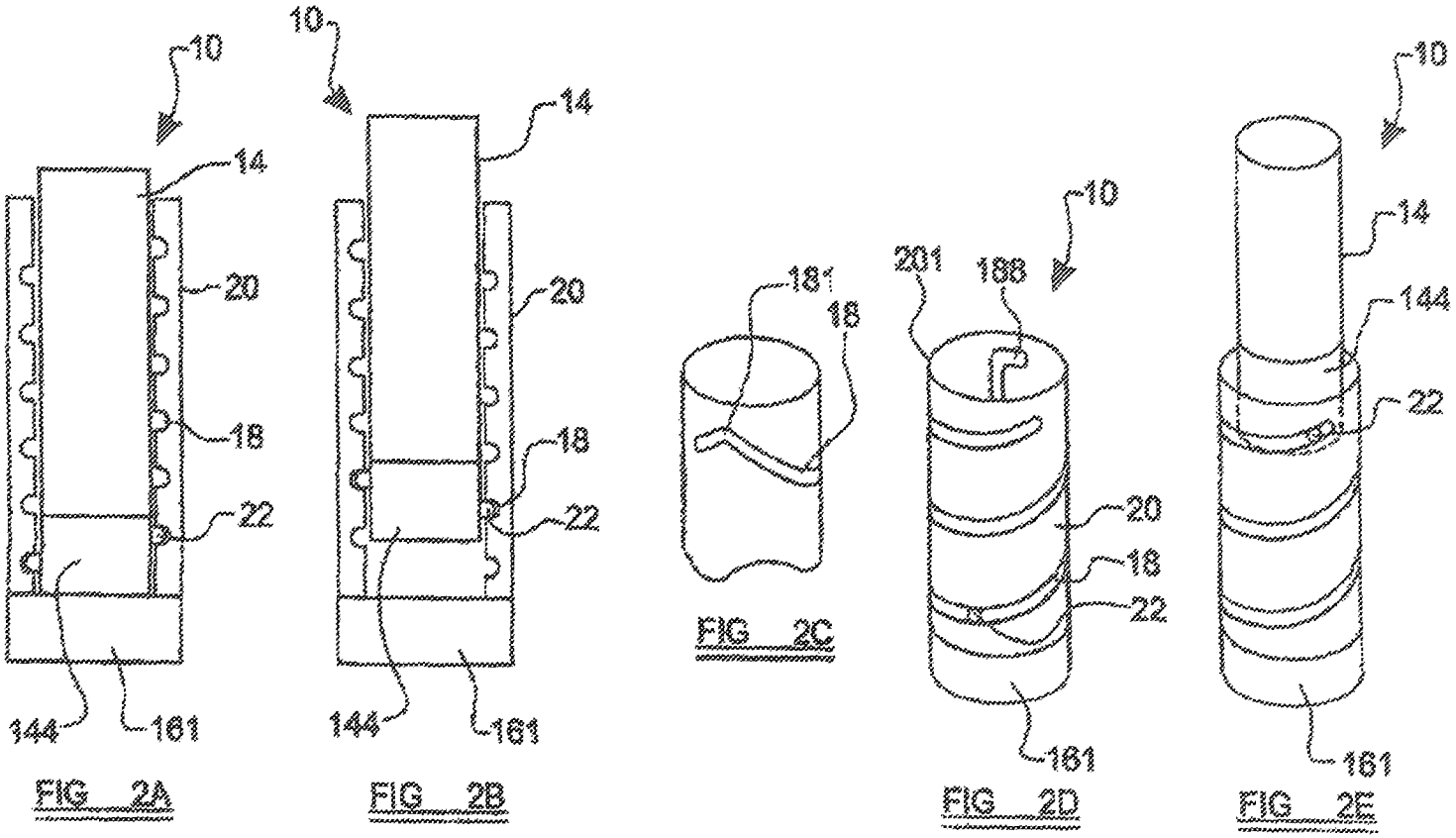
FIGS. 2A and 2B depict cross-sectional views of arrangements of the invention.
FIG. 2C depicts a perspective view of a portion of the housing depicted in FIGS. 2A-2B.
FIGS. 2D and 2E depict a perspective view of a further arrangement of the invention.

One arrangement of the present invention depicted in FIG. 2A has a rotatable actuator 161, which is coupled to a screw thread 18 located on or in the internal bore of the housing 20. The roller 14 is located by at least one pin 22 on the piston 144 on to the screw thread 18. Alternatively, the roller 14 may be located in the screw thread 18 on the internal bore 20 by a corresponding screw thread 221 on the piston 144, in the same manner that a nut may thread to a bolt, as shown in FIG. 2B.

When the actuator 161 is rotated, the roller 14 is then deployed from the housing 12, as the pin 22 or pins, or corresponding screw thread 221 travels up screw thread 18 on the housing. When the actuator 161 is rotated in the reverse direction the roller 14 is then retracted into the un-deployed position.

In this arrangement the piston 144 does not rotate freely, if desired, a spindle 143 may be attached to the piston 144, and the roll 142 can rotate about this, if the roll 142 should be rotatable. It is preferable that the roll 142 should be able to rotate or spin around, in use, for example about a spindle.

The screw thread 18 on the internal bore 20 of the housing 12 may be terminated by a catch arrangement. The catch may be a notch 181 disposed in the direction of the actuator, i.e. in the reverse of the direction of travel of the roller 14 when moving from un-deployed to deployed. See FIG. 2C for an example of such a catch. When the pin 22 or thread reaches the notch 181 the pin or thread drops down into the notch and the pin or thread can not travel up any further, therefore the notch also limits the maximum deployment of the roller 14 from the housing 12. It is to be appreciated that the roller arrangement 14 (including roll 142 and piston 144) may be resiliently biased to an un-deployed position using, for example, an extension spring. Therefore, when a 22 becomes seated in the notch then the pin 22 becomes captured because the spring biases the pin toward the proximal (un-deployed) end.

When the actuator 161 is then rotated in the reverse direction, i.e to move the roller 14 from the deployed to un-deployed position, there is a force against the spring biasing to move the pin 22 or thread 221 up and out of the notch and back down along the screw thread 18, where it can travel to the proximal end, so that the roller 14 moves to the un-deployed position.

It is to be appreciated that the larger the gap is between subsequent grooves of the screw thread 18, the fewer turns of actuator 161 are needed to deploy the roller 14.

In a further arrangement, as depicted in perspective in FIGS. 2D (un-deployed) and 2E (deployed) the roller 14 can be deployed in a manner similar to a lip balm. There is a screw thread 18 located on, or moulded or engraved on an internal bore of the housing 20. Housed within the housing is an inner sleeve 201, which has a transverse slot 188 therethrough. A pin 22 coupled to piston 144, passes through the transverse slot 188 of the inner sleeve 201 and the end of the pin 22 is located in the screw thread 18 of the inner bore 20. The inner sleeve is connected to a rotatable actuator 161. When the user rotates the actuator 161, the inner sleeve thus also rotates, driving the pin up both the screw thread and the transverse slot, so that the roller 14 is deployed in an axial motion.

When the user rotates the actuator 161 in the reverse direction, the inner sleeve 201, rotates in the reverse direction to so that the pin travels down transverse slot 188 and screw thread 18 to the un-deployed position.

This arrangement may further comprise a notch, to lock the roller 14 in the deployed position, as depicted in FIG. 2G. It can be appreciated that this arrangement may also further comprise a resilient biasing, such as spring bias to the deployed or un-deployed position, as described above in respect of FIGS. 2A and 2B.

Figure 3:
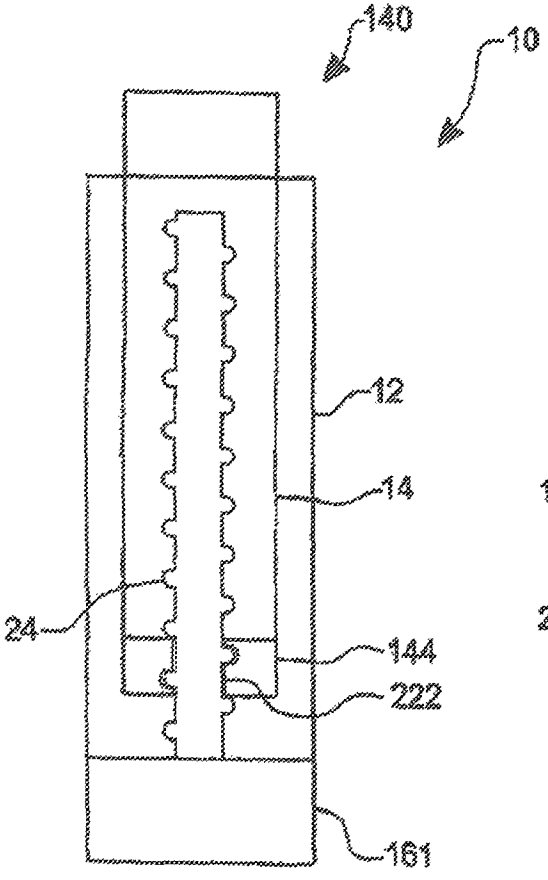
FIG. 3 depicts a cross-sectional view of an arrangement of the invention.

In another arrangement of the present invention, as depicted in FIG. 3 a rotatable actuator 161, is coupled to a screw 24, which is located in an internal chamber formed by roller 140, which hollow in this arrangement. A piston 144 is provided and has a thread 222 in a central piston bore, the thread 222 corresponding to screw 24. When the rotatable actuator 161 is turned, screw 24 rotates because it is attached to the actuator. Rotation of the screw 24 causes piston 144 to travel the screw 24 to deploy the roller 14, because of the correspondence between the threads on the piston 144 and screw 24. Similarly, when rotatable actuator 161 is rotated in the other direction the roller 14 is retracted into the housing.

Again, the larger the gaps between each adjacent thread of screw 24, the fewer rotations of actuator 161 are needed to deploy roller 14.

Figure 4B:
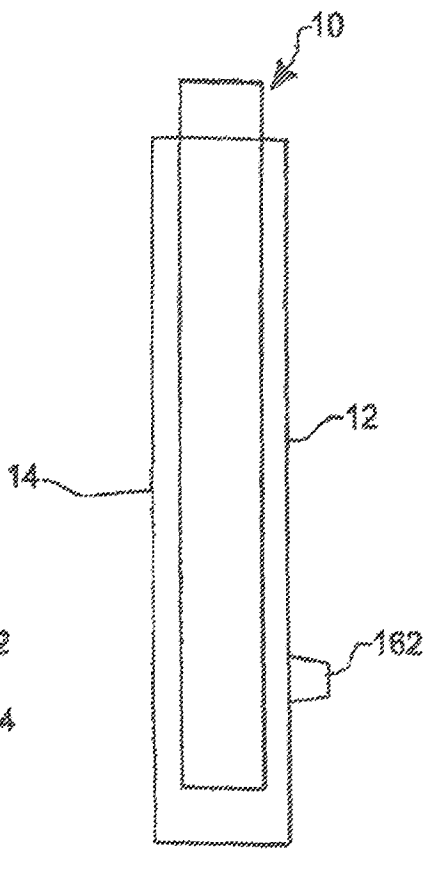
FIG. 4B depicts a side view of the arrangement of FIG. 4A.
Figure 4A:
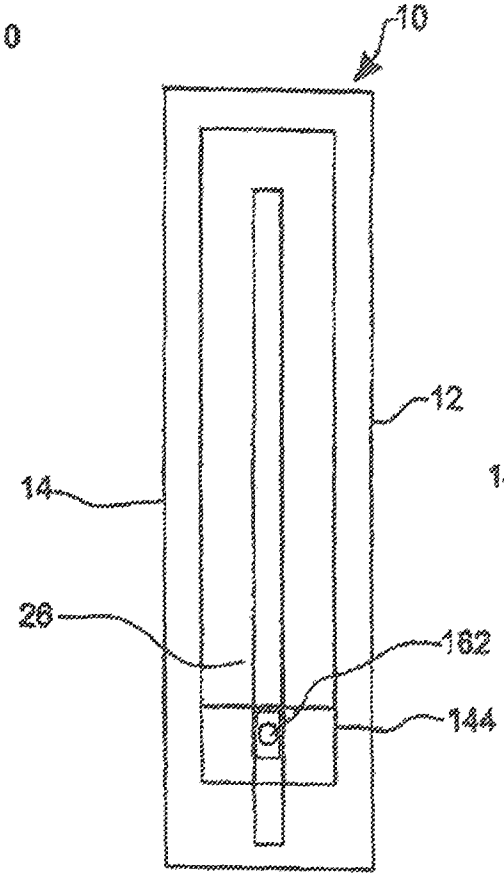
FIG. 4A depicts a cross-sectional view of an arrangement of the invention.

One further arrangement of the present invention shown in FIG. 4, in which the actuator 162 in this arrangement is a radial pin, coupled to the piston 144. The actuator 162 can slide up transverse slot 26 formed through the housing 12 to deploy the roller 14 from the housing 12. When the actuator 162 is slid up the slot 26 by a user, the roller 14 is deployed from the housing 12. It can be appreciated the actuator or pin 162 may be covered by a button or cap. As described further below, in this arrangement the roller arrangement 14 may be resiliently biased, for example using a coil spring, to the un-deployed (closed) position.

Figure 5:
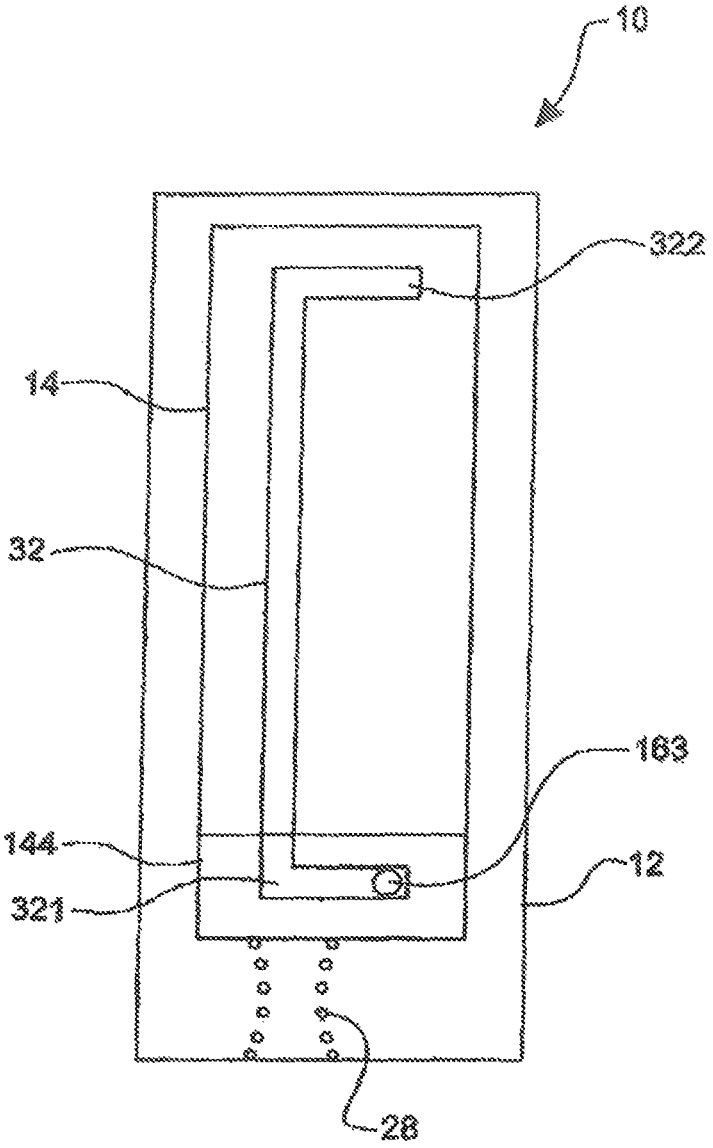
FIG. 5 depicts a cross-sectional view of an arrangement of the invention.

For example roller 14 and piston 144 may be biased by a spring 28 (see FIG. 5), although other resilient means may be used. The spring may be biased toward either the deployed or un-deployed position of the roller 14. As shown in FIG. 5, a spring, when compressed, biases the roller 14 to the deployed position and a trigger 163, in this case, a radial pin prevents the roller 14 from being deployed. In this arrangement it is to be understood that the trigger 163 is the actuator of the arrangement. When the user releases the trigger 163 by sliding the pin 163 circumferentially in a circumferential slot 321, the pin 163 can travel across the circumferential slot 321 which forms an L-shape with transverse slot 32. Once the pin 163 reaches the junction between the slots 321 and 32, the pin 163 can slide freely transversely through slot 32, under bias of the spring 28. The roller 14 is thus deployed.

There is a corresponding circumferential slot 322 at the distal end of the housing, forming an L-shaped region that can maintain the roller 14 in a deployed position when the pin 163 is slid circumferentially. To recompress the spring, the user holds the pin 163 again and slides the pin back across slot 322 down slot 32. The roller may be locked into the un-deployed position by sliding the pin 163 back across slot 321. It should be noted that the slot 32 may also be provided with notches instead of L-shaped regions formed by circumferential slots.

It can be appreciated that the pin or trigger 163 may also be resiliently biased radially inwards through the housing. Thus when the pin or trigger 163 pushes radially inwards until it passes through a hole in the housing, the spring 28 acts to slide the pin 163 and therefore the roller 144 up slot 32. It can be further appreciated a button or cap may cover the pin or trigger 163, for use to manipulate.

Figure 6B:
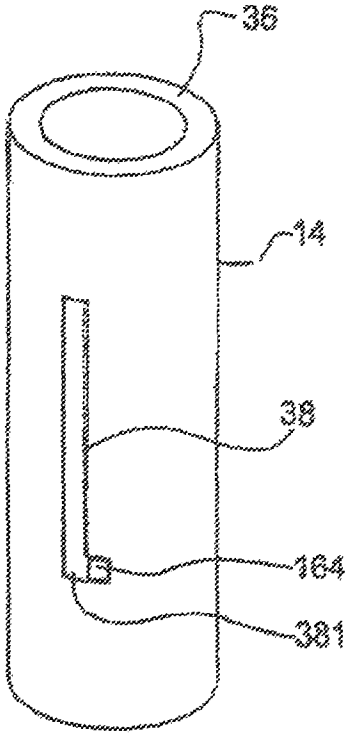
FIG. 6B depicts a perspective view of the component of FIG. 6A.
Figure 6A:
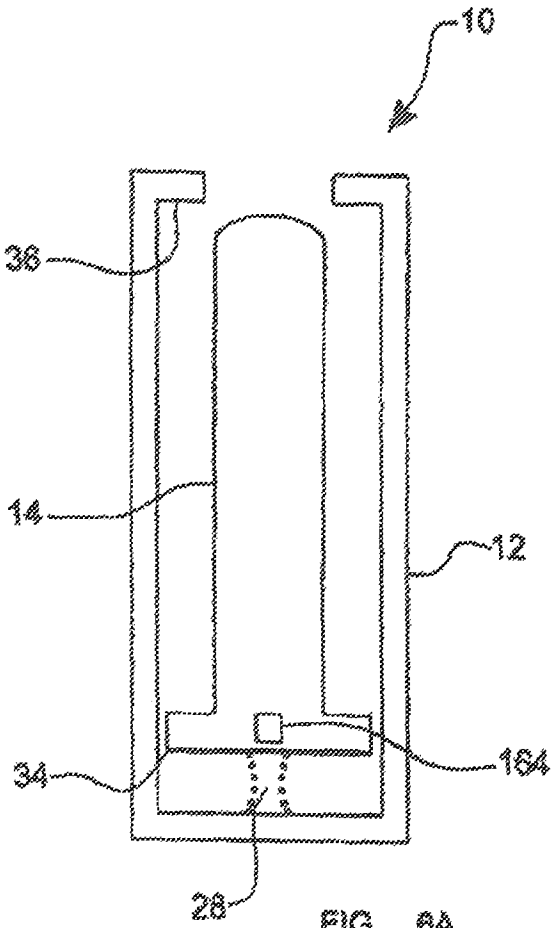
FIG. 6A depicts a cross-sectional view of an arrangement of the invention.

In a further embodiment of the present invention shown in FIG. 6A the roller 14 is biased towards the deployed position by compressed spring 28. The roller 14 is retained in the housing 12 by means a flange 34 on the proximal end, with a correspondingly dimensioned circumferential lip 36 on the distal end of the housing 12. Actuator or trigger 164 is a pin, which is coupled to roller 14, the pin correspondingly sized to L-shaped slot 38, depicted in FIG. 6B. When actuator or trigger 164 is manipulated, by circumferentially sliding the pin 164 across the horizontal section 381 of slot 38, the pin travels along and up slot 38, so that roller 14 is deployed. The roller 14 is then returned to the un-deployed position by compressing the spring 28, by sliding the pin down along the slot 38 and locked into position by circumferentially sliding the pin 164 across the slot 381. It can be appreciated that an optional cap may be present on the distal end of the roller 14, for the user to push to aid use of this arrangement.

It can be further appreciated that a flange 34 and circumferential lip 36 may also be present in other arrangements of the invention.

In an arrangement of the present invention a variety of configured and dimensioned slots and pins may be used to limit axial and rotational movement of the roller 14. The variety of slots and pins may be used to lock the roller 14 in the deployed or un-deployed position.

Figure 7:
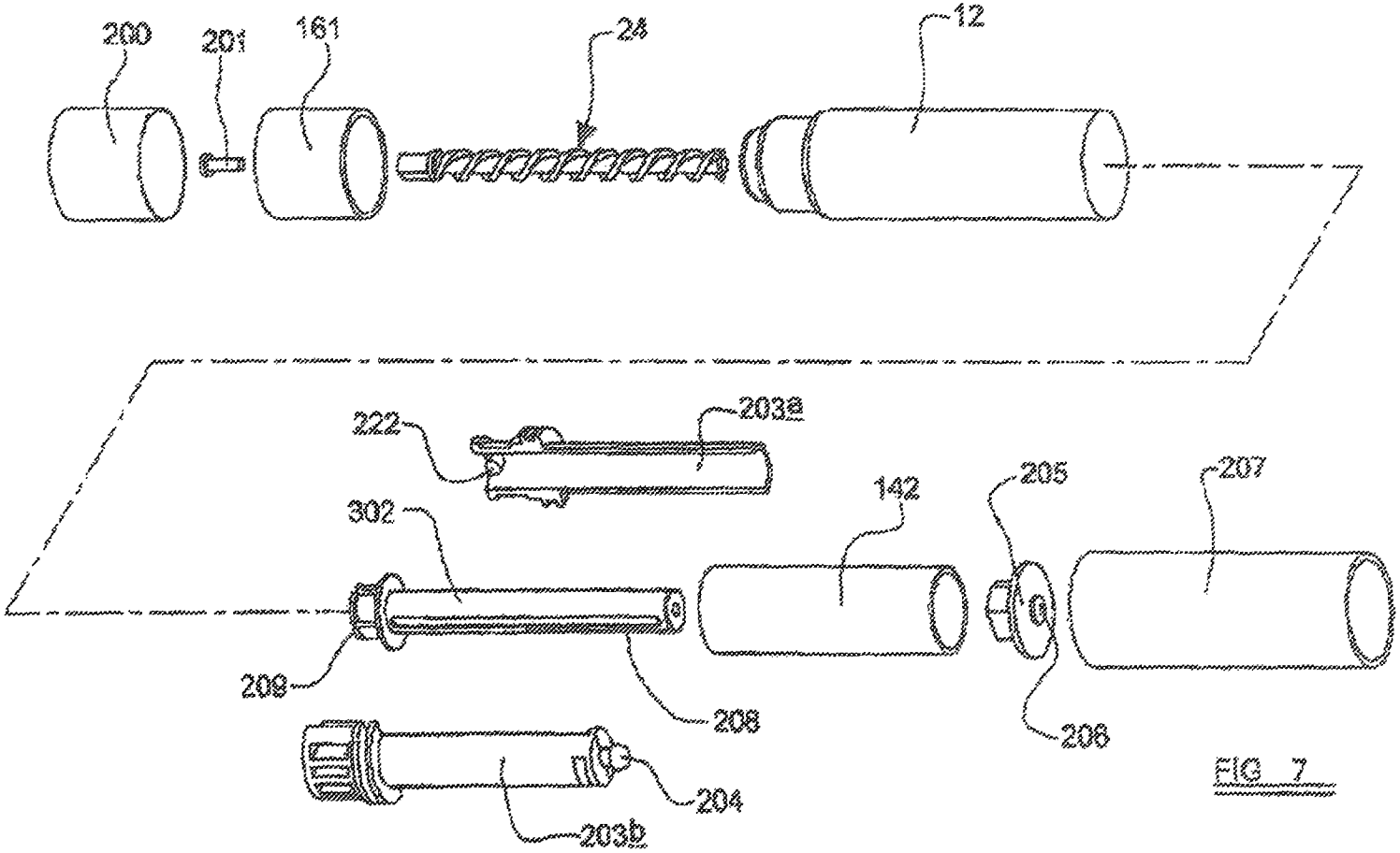
FIG. 7 depicts an exploded perspective view of a further device according to present invention.

FIG. 7 depicts a particularly preferred embodiment of the present invention. The FIG. 7 embodiment is somewhat similar to the embodiment depicted in FIG. 3 and like reference numerals will be used where possible. In this embodiment, the actuator 161 is a cap which is attached by means of a screw 201 or other fixing means to a screw-threaded helix 24. The main housing 12 of the device is attached to the actuator cap 161 by way of a snap fit, and the cap 161 is rotatable about housing 12. As depicted, the housing 12 includes a portion of narrower diameter as compared to the rest of the housing, which portion is dimensioned and configured to fit within and snap fit to the actuator 161, the snap fit comprising a lip on the housing 12 which is overcome by the cap 161.

In the embodiment depicted in FIG. 7 the roller 14 includes a or 262 which has flanges 209. The flanges 209 allow the core 202 to be clipped inside the narrower area of the housing 12 in such a way that the core is not rotatable with respect to the housing. It is therefore to be appreciated that, once assembled, the core 202 is clipped into the housing 12 and the helix 24 passes through the core 202. Cap 161 and helix 24 are together rotatable with respect to the housing 12 and core 202 together and the helix is coaxial with respect to the core and the housing.

Core 202 is provided, in the depicted embodiment, with two diametrically opposed longitudinal slots 208. In the FIG. 7 embodiment the core 202, which is generally cylindrical, is surrounded by a lint slider 203 which is divided into two respective halves 203*a* and 203*b*. As can be seen from FIG. 7, the two halves of the lint slider 203*a* and 203*b* clip together longitudinally, for example by a way of a snap fit which runs the length of the slider halves. However, these parts may alternatively be moulded together or fixed together for example by way of adhesive.

As depicted, each half 203*a* and 203*b* is provided, at each proximal end, with a lug 222 (the lug for half 203*b* is not visible in this figure, but is present). During assembly of the device, the two halves 203*a* and 203*b* are clipped together such that each respective lug 222 passes through each respective slot 208 of the core, such that the lugs project through and into the internal space defined by the core. The lugs 222 therefore form an internal screw thread for the roller, i.e. the lugs 222 engage with the thread of helix 24, which is a relatively broad helix.

Accordingly, once assembled and in use, relative rotation of the actuator (cap 161) with respect to the housing 12 (which remains still, being held by a user) causes rotation of the helix 24 within the core 302 which is also still. As the lugs 222 are threaded onto the helix 24, the lint slider 203 is wound up with respect to the core 302 as the lugs 222 are forced along slots 208. When the actuator is rotated in one direction, this causes the lint slider to protrude from the housing 12 and therefore be deployed. Movement of the slider 203 is limited by the distal ends of the slots 208, such that the slider 203 may protrude to a defined degree but no further, and may not be completely screwed out of the housing 12. Rotation of the actuator in an opposite direction causes the slider 203 to revert to the non-deployed position.

The roll of lint removing material 142 is, as in previous figures, a tube having a roll of lint removing material rolled around the outside. The roll 142 is dimensioned and configured to be seated around the outside of lint slider 203. It can be seen that one half of the lint slider, 203*b*, is provided with a knob 204 protruding from the end of lint slider 203. In use, after the roll 142 is seated on the lint slider 203, a refill cap 205 may be placed over the top of this combined arrangement. In other words, the lint roll 142 is pieced on the lint, slider 203 and they the refill cap 205 is placed over and covers the end of the lint slider and lint refill. The ref ill cap 205 is provided with a downwardly projecting rim which fits inside the roll of lint 142 and over the lint slider 203. Furthermore, the refill cap 205 is provided with an aperture 206 which corresponds with the knob 204. Accordingly, the refill cap 205 forms a snap fit with the knob 204 when the knob 204 engages with the aperture 206, in a manner known in the art.

As depicted in FIG. 7, whilst not necessary, the housing 12 may be covered by a cover 207 which can be made of any material such as plastic or metal and preferably a decorative metal. Furthermore, whilst it is not necessary to cover the actuator 161, this may optionally be covered by a further corresponding cap 200. For example, if the cover 207 is metal then the cap 200 may also be of identical metal material, so that the entire device is covered by a unitary metal cover which may be decorative or aesthetically pleasing.

The device may easily be recharged or refilled which a new roll of lint. This is achieved simply by removing the cap 203 from the end of the lint slider 203. This is easily achieved due to the snap fit connection between the aperture 206 of cap 205 and the knob 204 of slider 203. As known in the art, snap fit connections can be made having varying degrees of permanence depending on the radius of curvature of the knob 204 and corresponding aperture 206. Where the knob is relatively smooth and rounded, the force required to remove the knob from the aperture 206 of refill cap 205 may easily be supplied by a user. Once cap 205 is removed, the empty lint roll or spent lint roll 142 may be taken away and replaced with a new lint roll 142. It should also be noted that the lint roll 142, when placed on a slider 203, is rotatable about the slider 203 so that in use, the user may rotate the lint roll 142 over a surface to be cleaned. The lint roll 142 is retained on a slider 203 by an area or larger diameter at the proximal end of the slider 203 and an area of greater diameter on the cap 205.

In a further embodiment, not shown, the helix arrangement 24 may be dispensed with and one of the other mechanisms described above can be used. Without the helix 24 and corresponding thread 222, for example, the lint slider 203 may simply be pulled out of the housing 12 by a user, for example in the manner of a telescope. This is equivalent to the arrangement described above with respect to FIG. 1. Various means of maintaining the lint slider and therefore roller 142 in the operative (deployed) position may be used as described above, and those alternative mechanisms should be considered by the skilled person as being applicable to the arrangement of FIG. 7.

Figure 8:
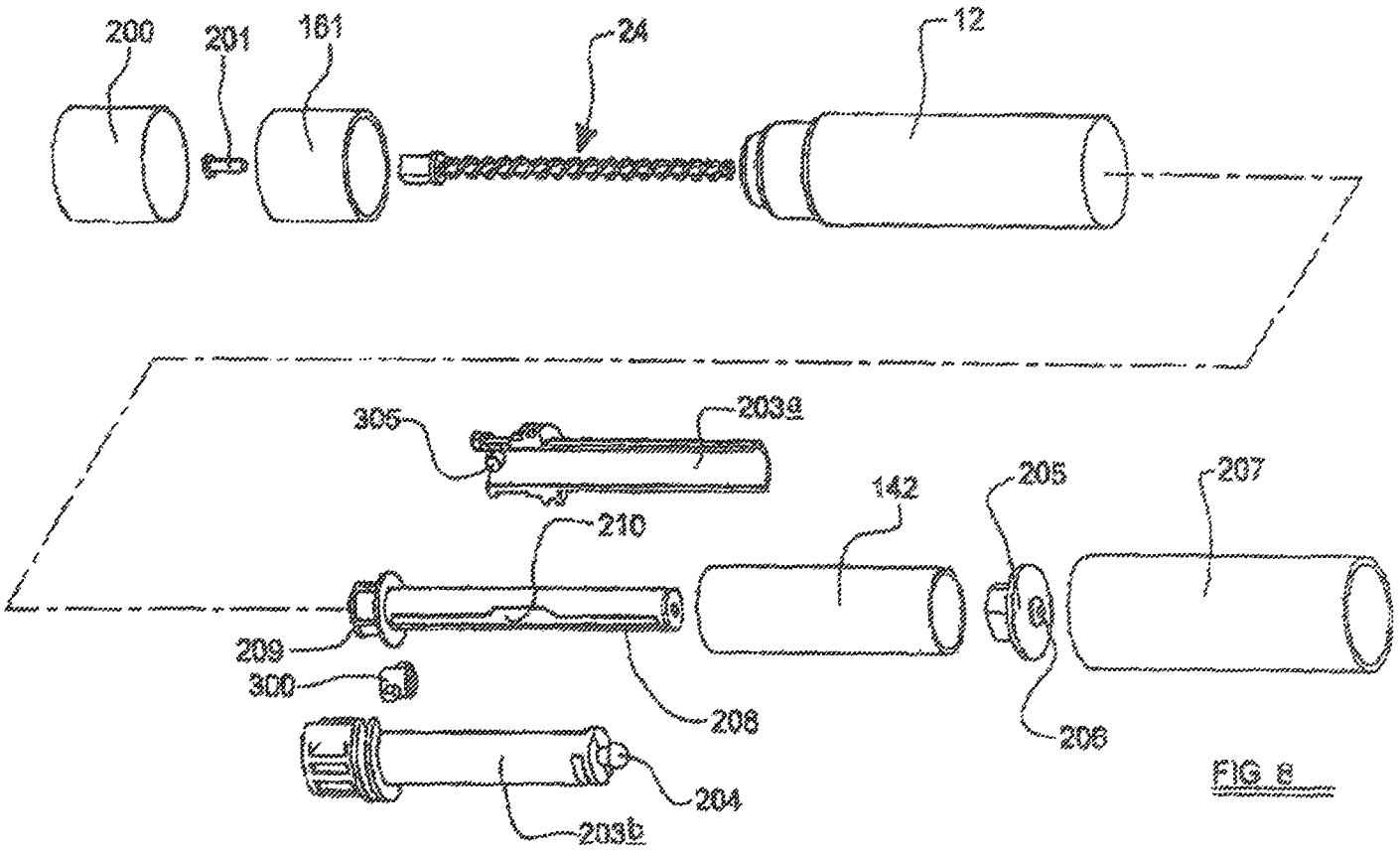
FIG. 8 depicts an exploded perspective view of an alternative device according to present invention.
Figure 9:
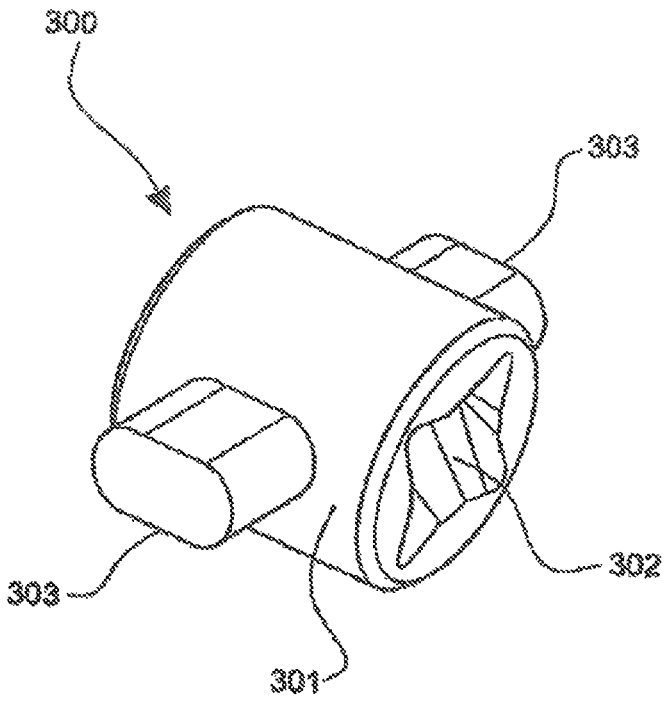
FIG. 9 depicts a traveller for use with the arrangement of FIG. 8.

A further alternative embodiment is depicted in FIG. 8 which in many ways corresponds to the arrangement of FIG. 7 and therefore like reference numerals are used. The major difference here is that instead of providing a screw thread by way of lugs 222, the roller is further provided with a traveller 300. The traveller 300 is enlarged in FIG. 9. The traveller 300 is a generally cylindrical body 301 having radially projecting lugs 303 and an internal bore 302 provided with an internal screw thread. The traveller 300 is dimensioned and configured (is similarly cylindrical as depicted) to fit within the internal space defined by the core 202, and may travel longitudinally up and down inside the core 202. The projecting lugs 303 of traveller 300 pass through the slots 203 of the core 202 (i.e. from the inside out, as opposed to the outside in for lugs 222, in FIG. 7). For ease of assembly the core 202 is provided with at least one cut-out 210 along the length of the slot 208. The cut-out 210 is of sufficient size to allow the traveller to pass through the cut-out and therefore be placed inside the core 202.

In the FIG. 8 arrangement, the two halves 203*a* and 203*b* of the slider 203 are provided with diametrically opposed sockets 305 which are sized and configured to receive the traveller lugs 303. Therefore during assembly, the traveller 300 is placed inside core 202 via cut-out 210 such that the lugs 303 project through slots 208. The halves of the slider 203 may then be brought together and the lugs 303 located in corresponding sockets 305. Accordingly the traveller 300 is trapped within the slider 203 but the lugs 303 in slots 208 allow the traveller-slider combination to travel longitudinally up and down the core. The screw thread 302 of traveller 300 is engaged with the screw thread of helix 24 so that the device functions exactly as described for FIG. 7.

It would be useful, and is therefore envisaged by the present invention, to sell to consumers the lint roll 142 together with cap 205, for ease of use.

Furthermore, the inventor of the present arrangement has discovered that an ideal dimension for this arrangement, in particular as described in FIGS. 7 and 8 has a length of around 100 to 150 mm and preferably 130 mm. The corresponding cross-sectional diameter of the arrangement could be around 25 to 40 mm, preferably 30-35 mm and most preferably 33.7 mm. These sizes allow the device of the invention to be carried around easily by a user either in a pocket or purse or hand bag. In arrangements of the present invention, the housing 12 is grippable by the user. The advantage of the grippable housing is that the housing assists the user with operation of the device.

There may be provided a removable cap or lid on the distal end of the roller 14. This cap may be dimensioned to the housing 12, so that when the roller 14 is in the undeployed position the cap forms a protective lid to the device. The cap may be fixed to the roller 14, for example via a snap fit or screw fit, although other methods to secure the cap may be used. The advantage of a cap is that the cap prevents dust or dirt entering the interior of the housing, also to aid use of the device as described above.

In one arrangement of the invention, there may be provided a cover for the device. The cover may completely cover the entire device, or the cover may partially cover the device so that a portion of the actuator is uncovered. The advantage of the cover would be that the cover may be fashioned to be aesthetically pleasing to the user. The cover may be fixed on to the device by a snap fit or screw fit or other means known in the art.

The present disclosure further comprises a method for using the device. In use the device can be used to remove unwanted material from the surface of an object, for example to remove lint or hair from clothes or other surfaces. The method comprises, manipulating the actuator 16 to deploy the roller 14. Once in the deployed position, roller 14 can be used to remove lint, or other such material.

The device 10 and the components thereof can be made of any material known in the art that would be suitable for the purpose, for example a plastic or metal.

When used in this specification and claims, the term "deployable" and variations thereof means the roller 14 is exposed from the housing 12, so that the roller 14 is in a useable position for performing the function of removing lint.

When used in this specification and claims, the term "moveable" and variations thereof means that the roller 14 or housing 12 can be moved with respect to the other.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A lint removing device comprising:

a housing;

a roller for holding a lint-removing material, wherein the roller and lint-removing material are dimensioned and configured to be housed by the housing, wherein the roller and housing are arranged such that the roller is deployable from the housing; and an actuator coupled with or formed by either the roller or the housing, the actuator being connected to or formed with a helix or screw thread that is coaxial with the housing, and the actuator being manipulable by a user to deploy the roller, characterised in that the actuator is arranged to transversely move the roller with respect to the housing.

2. The device of claim 1, wherein the roller and the housing are moveable with respect to each other.

3. The device of claim 1, wherein the actuator is rotatable with respect to the housing.

4. The device of claim 1, wherein the roller comprises at least one radially-projecting pin that engages a corresponding portion of the housing.

5. The device of claim 1, wherein the housing comprises at least one slot to receive a corresponding pin of the roller, and the roller is mounted on the housing by at least one radial roller pin or roller thread on a corresponding screw thread on an internal bore of the housing.

6. The device of claim 5, wherein the housing slot or housing screw thread is terminated by a catch to limit deployment of the roller.

7. The device of claim 1, wherein the actuator is coupled to the roller and is slidable along a slot of the housing to deploy the roller.

8. The device of claim 1, wherein the roller is resiliently biased and preferably spring biased to a deployed or undeployed position.

9. The device of claim 1, further comprising a notch on or in the housing to limit deployment of the roller.

10. The device of claim 1, wherein the proximal end of the roller has at least one flange.

11. The device of claim 1, wherein the distal end of the housing has at least one circumferential lip.

12. The device of claim 1, wherein the actuator is a trigger coupled to the roller.

13. The device of claim 1, wherein the actuator is formed by at least a section of the housing and wherein the actuator is movable to be at least partially housed by a further portion of the housing.

14. The device of claim 1, wherein the roller comprises a roll of lint-removing material and a piston.

15. The device of claim 1, wherein the roller further comprises a spindle.

16. The device of claim 1, wherein the lint-removing material comprises a backing material coated with an adhesive.

17. The device of claim 1, wherein the roll of lint removing material further comprises a tube around which the lint-removing material is wound.

18. The device of claim 1, wherein the housing is cylindrical.

19. The device of claim 1, further comprising a removable cover, preferably a metal cover.

20. The device of claim 19, wherein the cover comprises two parts, one part having a greater length than the other.

21. The device of claim 1, wherein the distal end of the roller is provided with a cap.

22. The device of claim 21, wherein the cap is connectable to the roller in order to retain the roll of lint removing material on the roller.

23. The device according to claim 1, wherein the coaxial helix or screw thread is engageable with a corresponding screw thread of the roller.

24. The device according to claim 23, wherein the roller screw thread is provided on the roller or on a traveller seated on or in the roller.

25. The device according to claim 24, wherein the roller comprises a lint slider element formed of two separable parts.

26. The device according to claim 25, wherein the roller further comprises a core having at least one and preferably two diametrically opposed, longitudinal slots.

27. The device according to claim 26, wherein the roller screw thread is provided by lugs of the roller, and if the roller comprises the slider element each part of the slider element is provided with a lug, the lugs being dimensioned and configured to travel along the or each longitudinal slot.

28. The device according to claim 26, wherein the roller screw thread is provided by an internal bore of the traveler, the traveler having lugs being dimensioned and configured to travel along the or each longitudinal slot.

* * * * *